US005803030A

United States Patent [19]

Cole

[11] Patent Number: 5,803,030

[45] Date of Patent: Sep. 8, 1998

[54] PHASE ADJUSTABLE CAM DRIVE

[76] Inventor: Kenneth Wade Cole, 3408 Mill Creek Rd., Carrollton, Ky. 41008

[21] Appl. No.: 781,404

[22] Filed: Jan. 10, 1997

[51] Int. Cl.[6] ..... F01L 1/344

[52] U.S. Cl. ..... 123/90.17; 123/90.31; 74/568 R; 464/1; 464/160

[58] Field of Search ..... 123/90.15, 90.17, 123/90.31; 74/567, 568 R; 464/1, 2, 160, 161

[56] References Cited

U.S. PATENT DOCUMENTS

| | | | |
|---|---|---|---|
| 3,685,499 | 8/1972 | Meacham et al. | 123/90.15 |
| 3,807,243 | 4/1974 | Yada | 74/63 |
| 3,827,413 | 8/1974 | Meacham | 123/90.15 |
| 4,481,912 | 11/1984 | Stwiorok et al. | 123/90.15 |
| 4,494,496 | 1/1985 | Nakamura et al. | 123/90.15 |
| 4,561,390 | 12/1985 | Nakamura et al. | 123/90.15 |
| 4,754,727 | 7/1988 | Hampton | 123/90.15 |
| 5,078,647 | 1/1992 | Hampton | 123/90.17 |
| 5,119,691 | 6/1992 | Lichti et al. | 123/90.17 |
| 5,152,263 | 10/1992 | Danieli | 123/90.15 |
| 5,172,661 | 12/1992 | Brune et al. | 123/90.17 |
| 5,219,313 | 6/1993 | Danieli | 464/2 |
| 5,234,088 | 8/1993 | Hampton | 192/44 |
| 5,326,321 | 7/1994 | Chang | 123/90.17 |
| 5,329,895 | 7/1994 | Nishida et al. | 123/90.17 |
| 5,355,849 | 10/1994 | Schiattino | 123/90.17 |
| 5,450,825 | 9/1995 | Geyer et al. | 123/90.17 |

*Primary Examiner*—Weilun Lo
*Attorney, Agent, or Firm*—Wood, Herron & Evans, L.L.P.

[57] ABSTRACT

A cam phase adjustor for an internal combustion engine includes a drive gear, an index gear, an actuator and a camshaft. Actuator is rotated and moves linearly to reciprocate the index gear in response to engine rpm changes. Linear movement of the index gear, which serves as the drive link between the drive gear and the camshaft, causes relative rotational motion between the spinning index gear and camshaft, thus changing the angular phase of the camshaft relative to the drive gear. This is used to advance or retard the opening and closing of the intake and/or exhaust valves of an internal combustion engine to improve engine performance over a wide range of operative engine speeds. Linear and rotational movements of the components are facilitated by cooperating grooves and balls in the respective components so there is rolling rather than sliding motion between the components.

24 Claims, 2 Drawing Sheets

PHASE ADJUSTABLE CAM DRIVE

FIELD OF THE INVENTION

This invention relates to phase adjustable, drive motion transmission apparatus and more particularly to apparatus for adjusting the phase of a camshaft relative to the crankshaft of an internal combustion engine. In a broader sense, this invention relates to changing the phase or angular positioning of one driven shaft with respect to a coupled driveshaft.

BACKGROUND OF THE INVENTION

In internal combustion engines having camshaft driven intake valves and/or camshaft driven exhaust valves, it is known that the efficiency of the engine at a particular speed is dependent on the timing of the opening and closing of the valves in relation to the position of the reciprocating piston. These pistons drive a crankshaft which is typically used to drive the valve cam through a gear, chain or belt linkage. The cam-timed opening and closing of the valves in each cylinder, so driven by the engine's crankshaft, in turn control the efficiency of each power cycle.

At low engine or crankshaft speeds, the timing or angular phase of the cam with respect to the crankshaft is critical. Slow engine speeds require opening the intake and exhaust valves at relatively early or advanced times for best performance. On the other hand, higher speeds require retardation of the valve timing for best performance at such high speeds. Fixed cams are at best a compromise, providing peak engine performance and only a very narrow range of engine speeds.

The ability to retard and advance the cam/valve timing during engine operation thus provides more optimum performance throughout the engine operating range without sacrificing performance at the extremes of engine operation.

More particularly, an internal combustion engine will typically have an operating range extending from about several hundred revolutions per minute (rpm) to several thousand revolutions per minute (rpm). If the valve-driven camshaft is fixed at a certain angular disposition or phase relative to the crankshaft, then the intake and/or exhaust valves in each cylinder open and close, relative to piston position in that cylinder, in exactly the same place or rather at the same timing for each cycle, regardless of engine speed. While such timing might exhibit peak efficiency at low engine rpm, for example, that cam timing will not produce peak efficiency at higher rpm engine speeds. Thus efficiency for a fixed angular position camshaft may be at a peak for only limited engine speeds, with efficiency being otherwise degraded on either side of that speed.

For example, an engine exhibiting peak horsepower and torque at one engine speed will not be able to reproduce such peak numbers at other speeds within that engine's operation range. Accordingly, the horsepower and torque curves for a given engine may appear bell-shaped, with peak readings only for a small rpm range. At other engine speeds, horsepower and torque may fall off, gas mileage capacity may decrease, engine longevity may decrease, or other engine performance characteristics may not be maximized.

In order to extend engine efficiencies, such as by producing flatter horsepower and torque curves extending over a longer range of engine rpm, it has been proposed to change the phase relation of the valve drive cam with respect to the piston position as the engine is operating and in response to speed changes. Thus, it has been found that the ability to retard the valve cam as engine rpm increases will extend the peak performance of the engine over a wider rpm range than will a fixed cam phase.

While numerous devices have been proposed to change the angular phase of a camshaft relative to the engine crank (i.e. piston position), such devices tend to be complex, of too numerous parts and of too short a life without high maintenance costs and down time. In addition, not all such devices work "on the fly" or during actual engine operation.

Accordingly, it has been one objective of the invention to provide improved apparatus for changing the angular phase of one driveshaft with respect to the angular position of an associated driveshaft.

Another objective of the invention has been to provide improved apparatus for changing the angular phase of a camshaft in an internal combustion engine with respect to the camshaft driving crankshaft of such engine.

Another objective of the invention has been to provide improved apparatus for changing the angular phase of a camshaft, with respect to a driving crankshaft, in an internal combustion engine as the engine is operated through its rpm range of operation.

To these ends, a preferred embodiment of the invention comprises a cam drive apparatus interconnecting a camshaft with a crankshaft gear in an internal combustion engine and including components operable to change the angular phase of the driven camshaft with respect to the angular position of the driving crankshaft. That cam drive apparatus includes an axially movable index gear interposed between a crankshaft driven gear and the driven camshaft.

Through a series of angled, cooperating grooves and balls in the index gear and cam shaft, the index gear both drives the cam shaft and adjusts its angular rotation proportionately to the drive gear.

An actuator moves the index gear longitudinally in response to the speed of the engine so the position of the cam shaft is phased for best performance, depending on engine speed. The cam shaft is preferably advanced when the engine is slowed and retarded when the engine is run faster to produce better performance such as increased horsepower throughout the engine's effective rpm range as compared to a static phase cam shaft. The operative parts are movably coupled and driven through a plurality of groove and ball interfaces, reducing wear and maintenance scheduling.

More particularly, the cam drive apparatus also contemplates an outer cover, the actuator, the cam attached index gear and a crankshaft driven drive gear all variously interconnected through a series of balls and grooves to produce the relative component moves required. The index gear both drives the camshaft and is shifted to adjust the angular orientation of the camshaft relative to the drive gear.

The actuator is mounted on the outer cover through a spiral groove in each part and balls lying in the grooves. When the actuator is rotated on the cover, the cooperating groove orientation is such that balls in the grooves force the actuator to also move linearly in an axial direction. This urges the index gear in an axial direction.

The index gear includes axial extending grooves cooperating with axial grooves in a hub of the drive gear and drive balls therein for driving the index gear while allowing for its axial movement. At the same time, spirally oriented grooves on the interior of the index gear cooperate with grooves in the camshaft so balls in these grooves drive and rotate the camshaft.

When the index gear is moved axially, however, this causes relative angular disposition between the index gear and cam, and thus results in an angular disposition of the camshaft relative to the drive gear. Thus the angular phase of the camshaft is changed, relative to the drive gear and crankshaft, responsive to changes in engine speed.

Selection of the angles of extension of the grooves determines the degree of angular phase adjustment responsive to linear displacement of the index gear. In typical internal combustion engines of the automotive type, for example, a phase change in camshaft orientation sufficient to produce a seven degree retardation of valve opening and closing relative to piston position is sufficient to produce flattened torque and horsepower curves across a significant range of engine speeds, maximizing engine power, torque, gas mileage and longevity over a significant operating range of engine speeds.

Use of balls and grooves, as described, to operatively interconnect the components of the cam drive apparatus produces a strong and long-wearing drive which accept lubrication well. Relative component motion is primarily based on rolling contact and not sliding contact, thus enhancing efficiency and longevity.

The invention thus contemplates and provides a cam drive apparatus of relatively few, long-wearing parts while tending engine performance significantly.

Moreover, while one typical use of the invention has been described in connection with conventional internal combustion engines, it should be appreciated that the invention is useful as well in more specialized applications where the relation of valve openings and dwell times are different than those described above, but where cam phase adjustment in relation to angular crank position is important. Racing engines, engines using double overhead cam shafts and other engines where parameters such as cam lobe separation angles are critical can all benefit from use of the invention, modified to produce the required angular phase changes.

These and other objectives and advantages will become readily apparent from the following written description of a preferred embodiment of the invention and from the drawings in which.

Figure 1:
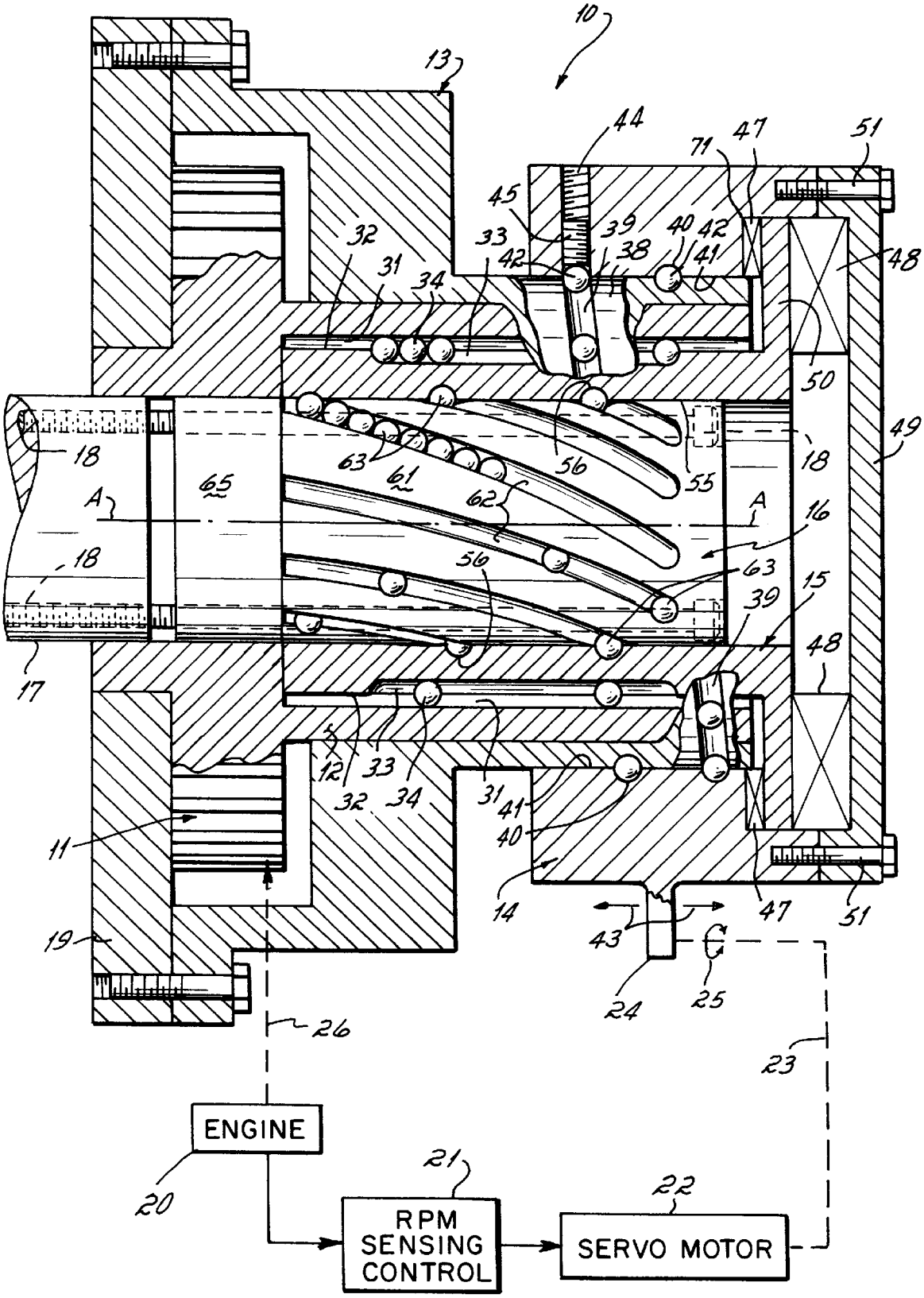
FIG. 1 is a cross-sectional view of the invention in diagrammatic form.
Figure 2:
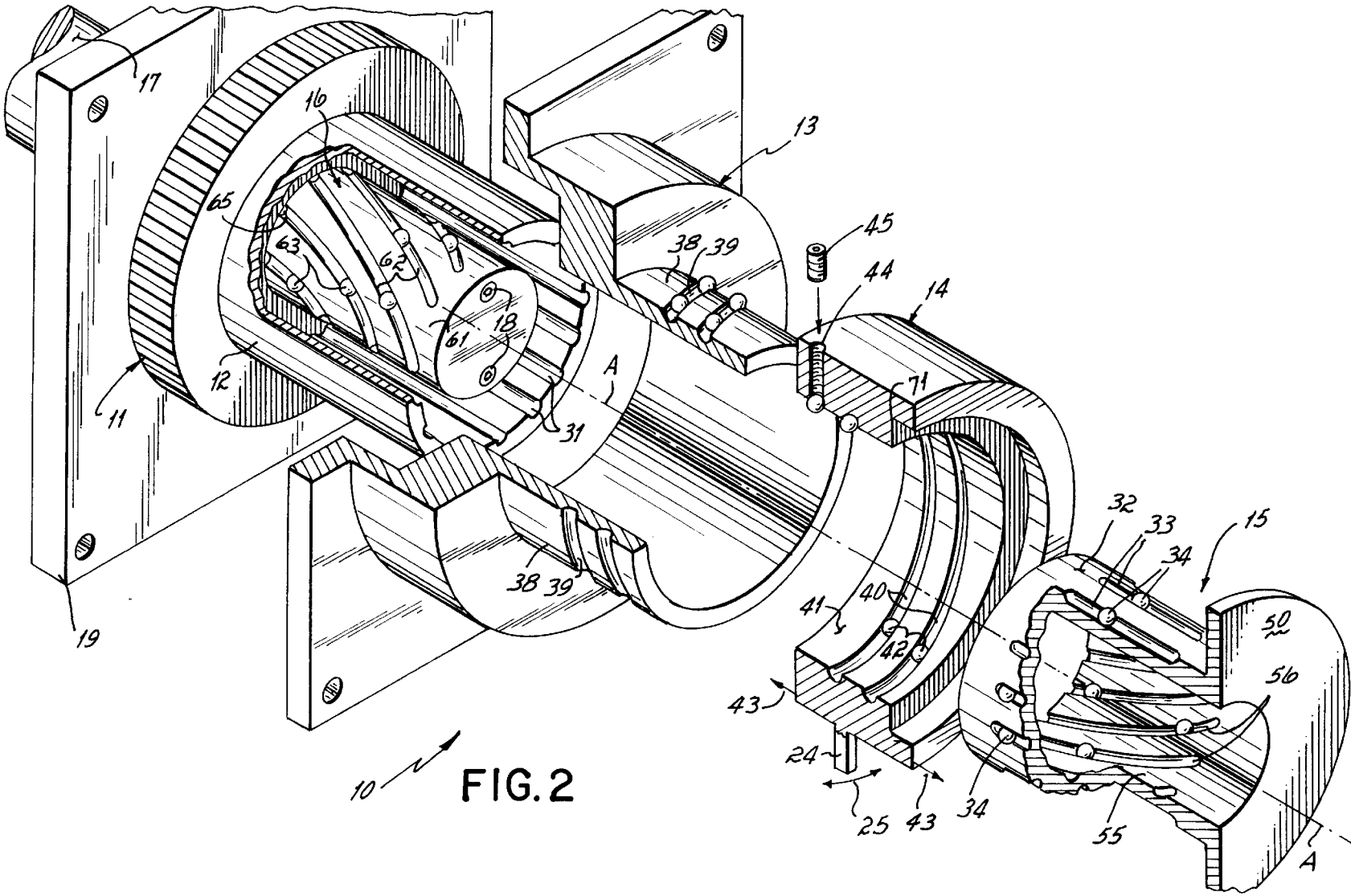
FIG. 2 is an exploded view of the invention of FIG. 1 in partial cross-section, and with several components not shown for clarity of description of certain operative components.

Turning now to the drawings, there is shown in FIG. 1 a camshaft drive apparatus 10 according to a preferred embodiment of the invention. FIG. 2 illustrates the invention in expanded form to facilitate this description. Camshaft drive apparatus 10 includes a number of major components, which include a drive gear 11 having a drive hub 12, an outer cover 13, an actuator housing 14 and an index gear 15. Camshaft gear 16 is adapted for endwise connection with the camshaft 17. The camshaft gear 16 is shown bolted by means of bolts 18 to the camshaft 17 (FIG. 1). It will be appreciated, however, that the camshaft gear 16 may be an integral extension of the camshaft 17 and will hereinafter be referred to sometimes as the camshaft 17.

It will be appreciated that the invention could be assembled to existing internal combustion engines and attached to camshafts, such as camshaft 17, by use of a camshaft gear 16. Otherwise and with respect to original equipment manufacturing, it may be preferred to have the camshaft gear 16 manufactured as an integral extension or portion of the camshaft 17. Further shown in the figures is an engine frame backing plate 19 which is also sometimes referred to as a rear mounting plate.

Further describing the general components with which the invention is utilized, it will be appreciated that the camshaft drive apparatus 10 is used, for example, with an engine, diagrammatically illustrated at 20 (FIG. 1), and provided with a speed sensing control or an rpm sensor 21. A servo motor 22 is connected to receive a signal from the rpm sensing control indicative of the rpm of the engine 20.

Through a mechanical link 23, the servo motor is attached to an actuator arm 24 for rotating the actuator housing 14, in a direction such as illustrated by the arrow 25. Any suitable mechanical link 23 and arm 24 may be utilized, it being appreciated that the rotation of the actuator housing 14 by the arm 24, through the control of the rpm sensor 21 and the servo motor 22, is the motion utilized to change the angular orientation or phase of the camshaft 17 with respect to the drive gear 11. The particular details of the engine 20, rpm sensor 21, servo 22, link 23 do not form part of the instant invention.

It will further be appreciated that the drive gear 11 is interconnected to the crankshaft (not shown) of the engine, as illustrated by the dotted link 26, the crankshaft driving the drive gear 11 through a suitable arrangement of gears. This drive could also be through a chain or timing belt and, in any event, it will be appreciated that the rotation of the drive gear 11 is generally in fixed proportion to the rotation of the crankshaft of the engine 20.

As is evident from the drawings , the various components noted above are provided with a plurality of rounded bottom grooves and balls. The grooves are extended on the components, as will be described, to cooperate and perform the various functions and motions of the elements as will also be described by means of the balls residing in complimentary groove halves.

While the grooves and the various details of the parts are perhaps best seen in overall fashion in FIG. 2, the interrelation of the parts are perhaps best seen in FIG. 1. Reference is made to both figures for the following description.

First, it will be appreciated that the drive gear 11 is preferably formed integrally with the drive hub 12. The drive hub 12 is provided with a plurality of internal, longitudinally extended round bottom grooves 31. As perhaps best seen in FIG. 1, it will be appreciated that the index gear 15 fits just within the interior of the drive hub 12. The outer surface 32 of index gear 15 is provided with a plurality of grooves 33. Each of the sets of grooves 31, 33 extend longitudinally in an axial direction defined by, for example, the axis "A". A plurality of balls 34 are disposed in cooperating grooves 31 and 33, such that the index gear 15 can be moved in an axial direction with respect to drive hub 12, and such that any rotation of the drive hub 12 will cause like rotation of index gear 15.

Thus, index gear 15 spins with drive hub 12 when the drive gear 11 is rotated by the engine 20. It will be appreciated that the drive gear 11 can be mounted by any suitable bearing, not shown, on the engine frame or rear mounting plate 19.

Turning now to the outer cover 13 and the actuator housing 14, the interrelationship of those parts will be described.

The outer cover 13 is provided with an outer circumferential surface 38 provided with a spiral groove 39. A complimentary spiral groove 40 is disposed in the interior surface 41 of the actuator housing 14. It will be appreciated that the grooves 39 and 40 lie in planes respectively, which are not perpendicular with the axis "A", but are slightly inclined with respect thereto so the cooperating grooves form a helical, blind groove.

When the arm 24 is moved in the direction of the arrow shown near the arm in FIG. 2, the actuator housing 14 is rotated on the surface 38 of the outer cover. Since there are a plurality of balls 42 captured in the respective grooves 39, 40, the actuator housing 14 is held onto the outer cover 13 by means of the balls and, because the grooves are offset from the perpendicular to the axis "A", the actuator housing is caused to move in a linear direction represented by the arrow 43 in FIG. 1.

Thus, as the actuator arm is moved in one direction, the actuator housing moves linearly in one direction. When the motion of the actuator arm 24 is reversed, the actuator housing 14 moves linearly in the opposite direction.

When assembled, the apparatus 10 includes thrust bearings 47, 48 and such wear plates, for example, as may be desired, on each side of the radial flange 50, which extends from the index gear 15, The assembly of the actuator housing 14, the index gear 15, the thrust bearings 47, 48 are held together by means of the bolts 51, securing the actuator end plate 49 to the actuator housing and thereby sandwiching the flange 50 of the index gear 15 between the thrust bearings 47, 48.

Turning now to the interface of the index gear 15 with the camshaft gear 16, it will be appreciated that the interior surface 55 of the index gear 15 is provided with a plurality of rounded bottom blind ended grooves 56, open at one end of the index gear 15. Grooves 56 do not extend linearly in the surface 55, nor parallel to the axis "A". Rather, the grooves are slightly curved in a spiral or helical fashion on the surface 55.

The camshaft gear 16 is provided with an exterior cylindrical surface 61 which has a plurality of rounded bottom blind end grooves 62 therein, open at one end. A plurality of balls 63 are disposed in the grooves 62 and the complimentary grooves 56.

Accordingly, it will be appreciated that when the index gear 15 rotates about the axis "A", the cam gear 16 is also driven by means of the interconnection of the index gear to the camshaft gear by the balls 63 disposed in the respective grooves 62 and 56.

It will also be appreciated that as the index gear is reciprocated linearly in the direction parallel to axis "A", there must be relative rotational movement between the index gear 15 and the cam gear 16, forced by the balls 63 residing in the respective and cooperating spiral grooves 62, 56.

It is this angular phase change between the angular orientation of the index gear 15 and the camshaft gear 16 which reorients the phase of the camshaft 17 with respect to the drive gear 11.

Returning now to the assembly and operation of the apparatus 10, it will be appreciated that a retainer 65 is interposed between the camshaft gear 16 and the camshaft 17. When it is desired to assemble the various parts, as illustrated in FIG. 2, and looking for the moment at FIG. 1 as well, the camshaft gear 16 is partially inserted into the left end of the index gear 15, as viewed in FIG. 1.

The balls are loaded into the respective and cooperating half grooves 56, 62, respective ones of which cooperate to form full ball receiving grooves. The balls 63 are thus inserted into the respective grooves as the camshaft gear 16 is moved to the right and into the index gear. Once all the balls are inserted, the retainer 65 is placed on the end of the camshaft gear 16 and the bolts 18 can be inserted to maintain the retainer on the left hand end of the camshaft gear 16 and thereby retain the balls in the respective grooves.

It thus will be appreciated that the grooves 56 in the index gear 15 have a blind end, as shown in both the figures and an open end at the left hand end of the index gear.

Next, the index gear 15 is partially inserted into the interior of the drive hub 12. It will be appreciated that the grooves 33 in surface 32 of the index gear, are half-rounded grooves having blind ends as shown in the figures. Nevertheless, when the index gear is only partially inserted into the drive hub 12, there is room to insert the balls 34 into cooperating ones of the grooves 33, 31.

Balls 34 are inserted into the complimentary grooves 31, 33 are filled up as the index gear is moved from right to left, as viewed in FIG. 1, and relatively into the drive hub 12, until the grooves are filled as desired.

At the same time, and previous to the insertion of the index gear 15 into the drive hub 12, the actuator housing 14 is slipped over the outer surface 38 of cover 13. At this point in time, no balls reside in the groove 39, 40.

Before the index gear 15 has its flange 50 moved into the actuator housing 14, one or more thrust bearings indicated at 47 are inserted between the shoulder 71 and the flange 50 of the index gear. Thereafter, one or more thrust bearings 48 are applied to the right hand side, as viewed in FIG. 1, of the flange 50 and the actuator end plate 49 is bolted by bolts 51 to the actuator housing 14, capturing the flange 50 between the thrust bearings 47, 48.

Thereafter, balls 42 are inserted through the access bore 44 in the actuator housing 14 into the cooperating grooves 39, 40 and a set screw 45 is screwed into the bore 44 to maintain the balls 42 therein.

Since the grooves 39, 40 are cooperating, spiral, rounded bottom grooves, any rotational motion of the actuator housing 14 on the outer cover 13 causes the actuator housing to reciprocate in a linear direction, as indicated by the double ended arrow 43 in FIG. 1, and thereby to move the index gear 15 linearly in a direction parallel to axis "A" to thus change the angular orientation of the cam gear 16 with respect to the index gear 15.

It will be appreciated that after the balls 42 have been inserted as described above, the bolts 18 are tightened to secure the cam gear 16 to the camshaft 17 with the retainer 65 secured therebetween, and that actuator end plate 49 is not secured until this is done.

Alternatively, as noted above, it is possible to manufacture the entire camshaft and camshaft gear 16 of one piece. In this regard, additional provisions must be made for insertion of the balls 63 into respective grooves 56, 62. This may be done, for example, from the rear end, or the right hand edge, of the camshaft gear 16. More particularly, the grooves 56, 62 could have an open end at the respective ends of the index gear 15 and the cam gear 16 with a lock plate or ball retainer plate being provided at the end of the camshaft to retain the balls therein after they have been loaded on assembly.

It will also be appreciated that other manufacturing and assembly techniques could be utilized with various access ports for the various balls provided in the various component with appropriate covers or plugs for retaining the balls therein.

It will also be appreciated that the apparatus 10 can be disposed within an outer housing for the purpose of containing lubricating fluid for circulation between the parts described herein, or various grease fittings or other lubricating apparatus could be provided.

Moreover, various seals may also be provided between the components of the invention for lubricant seal purposes. Such lubricant seals are well known and are not part of this invention.

It will also be appreciated that the invention thus contemplates several groove sets each comprising a complimentary half groove in one component operatively interfacing with a complimentary half groove in another part. See, for example, groove group set 31, 33; set 56, 62 and set 39, 40.

In use, and returning to FIG. 1, it will be appreciated that when the engine 20 is running, it drives the drive gear 11 at a speed in connection with the crankshaft of the engine 20. When the drive gear 11 and the drive hub thus rotate, this rotation spins the index gear 15 by means of the balls 34.

When the engine speed is increased, this is sensed by the rpm sensor 21, which generates a signal to control the servo motor drive through a mechanical link 23 to operate the arm 24 on the actuator housing 14. This rotates the actuator housing and in so rotating the actuator housing, that housing 14 is reciprocated linearly in a direction parallel to the axis "A" by means of the balls 42 residing in the spiral grooves 39, 40.

This linear motion is imparted through the thrust bearings 47, 48 to the flange 50 of the index gear 15. The index gear 15, while it is being rotated by the balls 34 and the grooves 31, 32, can also move linearly with respect to the drive hub 12, by virtue of the linear extension of the grooves 31, 32.

When the index gear moves linearly, the relative orientation of the cooperating spiral grooves 56, 62 with the intervening balls 63, drive the cam gear 16. But as the index gear 15 moves linearly with respect to the cam gear 16, the cam gear is slightly rotated, thereby advancing or retarding the phase of the camshaft 17 with respect to the drive gear 11.

Accordingly, the camshaft phase, with respect to the crankshaft which drives the drive gear 11, is adjusted so that the opening and closing of the intake and/or exhaust valves in the internal combustion engine can be advanced or retarded according to the actual rotational speed of the engine as that speed changes.

For example, and for best performance at low rpms, for example, the cam might open the intake valve at five degrees before top dead center (referring to the crankshaft orientation in degrees as a function of piston position) and close the intake valve at thirty-five degrees after bottom dead center.

On the other hand, when the engine speed is increased, it is desirable to retard the intake valve, so that they would open, for example, at two degrees after top dead center and close at forty-two degrees after bottom dead center.

By way of example only, the intake valves are thus controlled to open and close at different times with respect to the changes in engine speed, so that peak performance of the engine is provided both at lower rpm and at relatively higher rpm.

Proportional retardation is also accomplished between these two extremes so that for all various engine speeds between the extremes selected, the engine is operating at the best performance available.

The degree of retardation or advancement of the camshaft and therefore the valve openings and closings, will depend on the particular angles of the cooperating ball accommodating grooves between the various components, so as to optimize the particular phase adjustment for particular engines.

On the exhaust side, for example, when the engine is running at lower rpm, the exhaust valves might open at 85 degrees after top dead center and close at 5 degrees before top dead center. When the engine speed is increased, however, the exhaust valve opening and closing would be retarded to 92 degrees after top dead center and 2 degrees after top dead center, respectively, thereby enhancing the performance of the engine from the standpoint of the exhaust valves in between the rpm ranges selected, in the same way as the performance of the intake cycle of the engine was attained by the respective proportional advancing and retarding of the valves opening and closing in response to engine speed.

The ultimate result is that camshaft retardation and advancement with respect to the crankshaft is accommodated during engine operation as a function and in response to engine speed. Motion of the parts is generated by rolling contact rather than sliding contact, thereby eliminating friction while, at the same time, peak performance of the engine is obtained throughout significant operating rpm range. Mileage and efficiency of the engine is thereby increased.

Such transmission for the angular adjustment of the driven shaft with respect to a drive shaft, could be utilized for other applications and various feedbacks could be utilized for closed loop control to maximize the actual performance.

Moreover, the invention can be used effectively in other applications requiring different phase ranges and motions as suggested above.

It will also be appreciated that all of the grooves discussed herein, which operate in conjunction with balls, are essentially half grooves of semi-cylindrical shape having a radius substantially equal to or only slightly greater than the radius of the balls utilized for tolerance and wear purposes, and that the grooves are relatively round bottomed and have the blind ends, as described, for ball retention.

It also should be appreciated that it may not be necessary to totally fill the grooves with balls, but that there may be less balls required to fill a groove, consistent with smooth running lubrication and operation. Also with respect to the balls, it will be appreciated that while a sufficient number of balls for driving purposes are used, there is still sufficient groove length without ball interference to accommodate any relative motion as required between the parts as described.

It will also be appreciated that the various surfaces and balls could be hardened to increase the wear.

These and other advantages and modifications will become readily apparent to those of ordinary skill in the art without departing from the scope of the invention, and the applicant intends to be bound only by the claims appended hereto.

What is claimed is:

1. Apparatus for changing the angular phase between a drive shaft and a driven shaft and comprising:

an index gear operably disposed and interconnected between said drive shaft and said driven shaft and being rotatable about an axis of rotation and movable axially along said axis of rotation;

a first coupling means comprising a plurality of balls disposed in respective cooperating grooves in said index gear and in said drive shaft respectively for coupling said index gear to said drive shaft for rotationally driving said index gear about said axis of rotation, said first coupling means permitting motion of said index gear in an axial direction along said axis of rotation, and a second coupling means comprising a plurality of balls disposed in respective cooperating grooves in said index gear and in said driven shaft respectively for coupling said index gear to said driven shaft for rotationally driving said driven shaft, and for rotating said driven shaft with respect to said index gear when said index gear is moved in said axial direction;

said second coupling means being separate and independent from said first coupling means.

2. Apparatus for adjusting the phase of a rotatable driven shaft with respect to a driveshaft, said apparatus being operatively interposed between the shafts and comprising:

an index gear interconnected directly to the drive shaft and interconnected directly to the driven shaft, and driving the driven shaft as the drive shaft turns;

an actuator disposed radially outwardly of the index gear for moving the index gear linearly;

a coupling directly interconnecting the index gear with the driven shaft independently of the interconnection between the drive shaft and the index gear such that linear motion of the index gear changes the angular phase of the driven shaft with respect to the index gear and with respect to the drive shaft;

wherein said coupling includes elongated grooves in the index gear in cooperative alignment with elongated grooves in the driven shaft and balls disposed in said respective cooperating grooves for driving said driven shaft and for rotating said driven shaft relative to said index gear when said index gear is moved linearly.

3. Apparatus as in claim 2 wherein said grooves in said driven shaft and said grooves in said index gear are spirally oriented.

4. Apparatus as in claim 3 wherein said actuator is mounted on a cover and including:

a spiral groove in said cover;

a spiral groove in said actuator;

balls disposed in cooperating ones of said spiral cover and actuator grooves for urging said actuator linearly when it is rotated on said cover.

5. Apparatus as in claim 4 wherein said index gear has a radial flange oriented for movement linearly by said actuator.

6. Apparatus as in claim 5 including a drive gear and drive hub rotated by said drive shaft, said index gear disposed within said drive hub.

7. Apparatus as in claim 6 including linearly extending grooves in said hub, linearly extending grooves in an exterior surface of said index gear, balls residing in cooperatively oriented, linearly extending grooves in said hub and index gear for rotating said index gear about an axis and for accommodating linear reciprocating motion of said index gear.

8. Apparatus as in claim 7 including an arm on said actuator for rotating said actuator on said cover.

9. Apparatus as in claim 8 including a part in said actuator for loading balls into the spiral grooves disposed between the cover of the actuator.

10. Apparatus as in claim 3 wherein said spirally oriented grooves in said index gear are open at one end of said index gear and are blind at opposite ends of said grooves.

11. Apparatus for adjusting the phase of a camshaft of an internal combustion engine with respect to a crankshaft operated drive gear thereon and comprising:

a drive gear having a hub, an index gear disposed for operative connection to the hub, and being driven thereby, a camshaft rotatably disposed within said index gear and being driven thereby, and a plurality of cooperating groove sets in said drive gear, said index gear and said camshaft with driving balls operably disposed in respective cooperating groove sets for rotating said index gear and said camshaft with said drive gear hub, for accommodating linear motion of said index gear and for rotating said camshaft with respect to said index gear upon linear motion of said index gear.

12. Apparatus as in claim 11 wherein a first set of cooperating grooves extends linearly and axially in each of said drive gear hub and said index gear.

13. Apparatus as in claim 12 wherein a second set of cooperating grooves is oriented spirally in opposed surfaces of said index gear and said camshaft.

14. Apparatus as in claim 13 further including an index gear actuator, an outer cover, another set of cooperating grooves disposed between said cover and said actuator, said other set being spirally oriented, and a plurality of balls in said other set of grooves for moving said index gear actuator linearly when it is rotated on said outer cover to move said index gear linearly.

15. Apparatus as in claim 14 wherein said balls and said grooves are oriented to cooperate to retard said camshaft in angular phase relative to said drive gear when speed of said drive gear is increased, and to advance said camshaft in angular phase relative to said drive gear when speed of said drive gear is reduced.

16. Apparatus as in claim 15 wherein said spirally oriented grooves in said index gear are blind at one end and open at another.

17. Apparatus as in claim 15 wherein said spirally oriented grooves in said camshaft are blind at one end and open at another.

18. Apparatus as in claim 15 wherein said linearly extending grooves in said index gear are blind grooves.

19. Apparatus as in claim 15 wherein said linearly extending grooves in said drive gear are open at least at one end thereof.

20. Apparatus as in claim 15 including a ball loading port in said actuator for loading balls between said actuator and said cover.

21. Apparatus for adjusting the phase of a camshaft of an internal combustion engine with respect to a crankshaft operated drive gear thereon and comprising:

a drive gear having a hub, an index gear disposed for operative connection to the hub, and being driven thereby, a camshaft rotatably disposed within said index gear and being driven thereby, and a plurality of cooperating groove sets in said drive gear, said index gear and said camshaft, a plurality of sets of driving balls operably disposed in respective cooperating groove sets for rotating said index gear and said camshaft with said drive gear hub, for accommodating linear motion of said index gear and for rotating said camshaft with respect to said index gear upon linear motion of said index gear, one set of driving balls being operably disposed between and coupling said drive gear and said index gear and another set of drive balls being operably disposed between and coupling said index gear to said camshaft.

22. Apparatus for adjusting the phase of a camshaft, rotating on an axis, of an internal combustion engine with respect to a crankshaft operated drive gear thereon and comprising:

a hub on said drive gear;

an index gear operably disposed between said hub and said camshaft;

a set of cooperating grooves in said hub and a set of cooperating grooves in said index gear;

a set of balls disposed in said groove sets coupling said hub to said index gear;

another set of grooves in said index gear and another set of grooves in said camshaft;

another set of balls disposed in said other groove sets for coupling said index gear to said camshaft;

at least one of said other sets of grooves being disposed in a non-axial direction with respect to an axis of rotation of said camshaft;

and an actuator for moving said index gear in an axial direction to adjust said phase.

23. Apparatus for adjusting the angular phase of a driven shaft with respect to a drive shaft and comprising:

an index gear;

a drive gear connected to said drive shaft;

a set of cooperating grooves in said drive gear and in said index gear, said grooves disposed in an axial direction with respect to an axis of rotation of said driven shaft;

a plurality of balls in said grooves for imparting rotational motion between said index gear and said drive gear;

a second set of cooperating grooves in said index gear and in said driven shaft;

another plurality of balls in said second set of cooperating grooves for imparting rotational motion between said index gear and said driven shaft;

said index gear being rotatable about its axis of rotation and being movable in an axial direction therealong; and an actuator for moving said index gear in an axial direction.

24. Apparatus as in claim 23 wherein said second set of grooves extend in a non-axial direction.

* * * * *